US006510823B2

(12) United States Patent
Hirano et al.

(10) Patent No.: US 6,510,823 B2
(45) Date of Patent: Jan. 28, 2003

(54) TWO-CYLINDER OVERHEAD-VALVE V-ENGINE

(75) Inventors: Michio Hirano, Akashi (JP); Takemi Inoue, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/944,194

(22) Filed: Sep. 4, 2001

(65) Prior Publication Data

US 2002/0029753 A1 Mar. 14, 2002

(30) Foreign Application Priority Data

Sep. 8, 2000 (JP) ..... 2000-273121

(51) Int. Cl.[7] ..... F01L 1/30
(52) U.S. Cl. ..... 123/54.4; 123/90.25
(58) Field of Search ..... 123/54.4, 90.25, 123/90.31

(56) References Cited

U.S. PATENT DOCUMENTS 4,054,108 A * 10/1977 Gill ..... 123/54.4
4,058,092 A * 11/1977 Hikosaka et al. ..... 123/54.4
4,449,491 A * 5/1984 Tsuchiyama et al. .... 123/90.36
4,455,975 A * 6/1984 Kume ..... 123/54.6
4,662,322 A * 5/1987 Tamba et al. ..... 123/41.86
4,739,675 A * 4/1988 Connell ..... 123/90.48
4,852,527 A * 8/1989 Beardmore et al. ..... 123/90.46
5,235,942 A * 8/1993 Olmr ..... 123/90.44
5,732,670 A * 3/1998 Mote, Sr. ..... 123/90.39
5,813,377 A * 9/1998 Matsunaga ..... 123/90.17
5,937,804 A * 8/1999 Kaminski ..... 123/54.7

FOREIGN PATENT DOCUMENTS

JP A 10-159510 6/1998

* cited by examiner

*Primary Examiner*—Noah P. Kamen
*Assistant Examiner*—Jason Benton
(74) *Attorney, Agent, or Firm*—Oliff & Berridge, PLC

(57) ABSTRACT

A two-cylinder overhead-valve V-engine has two cylinders arranged so as to form a V-bank (S). Each cylinder is provided with push rods (15, 16) for operating an intake valve rocker arm (12) and an exhaust valve rocker arm (13). The push rods (15, 16) of each cylinder extend gradually away from each other toward a valve rocker arm chamber. An air intake passage is formed between the push rods (15, 16) in the cylinder head (3) of each cylinder. An air intake port (24) is formed in the cylinder head (3) so as to open into the V-bank (S). The air intake port (24) of each cylinder head (3) is connected by the air intake passage formed in the V-bank (S) to a carburetor disposed in the V-bank (S). A water jacket outlet (25) is formed near the air intake port (24) in a part of the cylinder head (3) in between the push rods(15,16). The water jacket outlets (25) of the cylinder heads (3) are connected by a cooling water passage adjacent to the air intake passage.

3 Claims, 8 Drawing Sheets

TWO-CYLINDER OVERHEAD-VALVE V-ENGINE

BACKGROUND OF THE INVENTION

1. Field of the Invention

The present invention relates to a two-cylinder overhead-valve V-engine and, more specifically, to improvements in the arrangement of an air intake passage and a cooling water passage in a water-cooled two-cylinder overhead-valve V-engine.

2. Description of the Related Art

FIG. 11 shows a conventional water-cooled two-cylinder overhead-valve V-engine in which a head cover and a carburetor are removed. An intake valve rocker arm 102 and an exhaust valve rocker arm 103 are placed on the cylinder head 101 of each cylinder. The intake valve rocker arm 102 has one end in contact with an intake valve and the other end in contact with an intake valve driving push rod 106. The exhaust valve rocker arm 103 has one end in contact with an exhaust valve 107 and the other end in contact with an exhaust valve driving push rod 108.

The cylinder head 101 is provided with an air intake port 110 in one end part thereof on one side with respect to a direction parallel to the axis $O_1$ of a crankshaft, and an exhaust port 111 in the other end part thereof on the other side with respect to the direction parallel to the axis $O_1$ of the crankshaft. A water jacket has an outlet 113 formed in a part of the cylinder head 101 on the side of the air intake port 110.

An intake manifold 120 is disposed on the side of the air intake port 110 and has an air intake passage 131 and a cooling water passage 121 adjacent to the air intake passage 131. The air intake passage 131 has one end directly connected to the air intake port 110 of the cylinder head 101 of one of the two cylinders, and the other end connected through a thermostat case 115 to the air intake port 110 of the cylinder head 101 of the other cylinder. The cooling water passage 121 has one end directly connected to the outlet 113 of the water jacket of one of the two cylinders, and the other end connected through the thermostat case 115 to the outlet 113 of the water jacket of the other cylinder.

The thermostat case 115 includes a first cooling water inlet 116 connected to the outlet of the water jacket, a second cooling water inlet 122 connected to the cooling water passage 121 of the intake manifold 120, a first cooling water outlet 125 connected to a water pump by a bypass pipe 124, a second cooling water outlet 118 connected to a cooling water return opening of a radiator, and a thermostat 114. The thermostat 114 measures the temperature of cooling water at the outlet of the water jacket, connects the cooling water passage 121 to the bypass pipe 124 when the measured temperature is lower than a set temperature or to the radiator when the measured temperature is not lower than the set temperature.

The intake manifold 120 is provided in its upper middle part with an inlet opening 137. The inlet opening 137 is connected to a carburetor, not shown, disposed above the intake manifold 120.

FIG. 12 is an enlarged sectional view taken on line XII—XII in FIG. 11. Push rods 106 and 108 are extended in substantially parallel to each other into the cylinder head 101 and a cylinder block 140. The lower ends of the push rods 106 and 108 respectively rest on tappets 141 engaging a camshaft 142.

As shown in FIG. 11, when the air intake port 110 and the cooling water outlets 113 are formed in the end parts of the cylinder head on one side with respect to the direction parallel to the axis $O_1$ of the crankshaft, and the air intake ports 110 and the cooling water outlets 113 are connected by the intake manifold 120 disposed on the side of the air intake ports 110, the engine inevitably has a big dimension along the direction of the axis $O_1$ of the crankshaft, and the air intake passage between the carburetor and the air intake port 110 of each cylinder head 101 is inevitably long. An art relating with the present invention is disclosed in Japanese Laid-Open Publication No. Hei 10-159510.

SUMMARY OF THE INVENTION

Accordingly, it is an object of the present invention to provide a water-cooled two-cylinder overhead-valve V-engine of compact construction having short air intake passages by changing opening positions of air intake ports and cooling water outlets of water jackets so as to use a bank space effectively.

The present invention a two-cylinder overhead-valve V-engine includes: a pair of cylinders arranged so as to form a V-shape in which a V-bank is formed, each of said cylinders including a cylinder head with an intake valve and an exhaust valve; a camshaft disposed below said V-bank in parallel to an axis of a crankshaft; intake valve rocker arms for operating said intake valves, respectively; exhaust valve rocker arms for operating said exhaust valves, respectively; and push rods for operating said intake valve rocker arms and said exhaust valve rocker arms, respectively, said push rods being connected to said camshaft by tappets, respectively, each pair of said push rods for each of said cylinders being extending gradually away from each other toward each of valve rocker arm chambers in which said valve rocker arms are housed, wherein, between each pair of said push rods for each of said cylinders, each of air intake passages with air intake ports for said cylinder heads is formed, each of said air intake ports being formed so as to open into said V-bank, each of said air intake ports being connected by each of said air intake passages formed in said V-bank to a carburetor disposed in said V-bank.

Since the V-bank can be used effectively for installing the intake manifold and the carburetor, this two-cylinder overhead-valve V-engine has a comparatively small dimension in the direction of an axis of a crank shaft, and the carburetor can be connected to the air intake ports of the cylinder heads by short, straight air intake passages. Consequently, the passage resistance of the air intake passages is small. The engine is able to respond quickly to throttle opening adjustment. Moreover, the stagnation of the fuel and the oil in the air intake passages can be prevented.

Preferably, together with said air intake ports, cooling water outlets of water jackets for said cylinders are formed so as to each open between each pair of said push rods for each of said cylinders, said cooling water outlets of said water jackets being connected by a cooling water passage adjacent to said air intake passages disposed in said V-bank.

Accordingly, part of the cooling water pipe system can be disposed in the V-bank so as to be simplified with the result that the two-cylinder overhead-valve V-engine can be formed in compact construction. Since the cooling water passage through which the cooling water heated in the water jacket flows is formed adjacently to the intake air passages, walls forming the intake air passages are heated to promote the gasification of the fuel flowing through the air intake passages.

Preferably, said cooling water passage connecting said cooling water outlets of said water jackets is provided with a cooling water outlet connected to a radiator.

Accordingly, the cooling water pipe system can be formed in a simple, compact arrangement and the engine can be formed in compact construction.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 2:
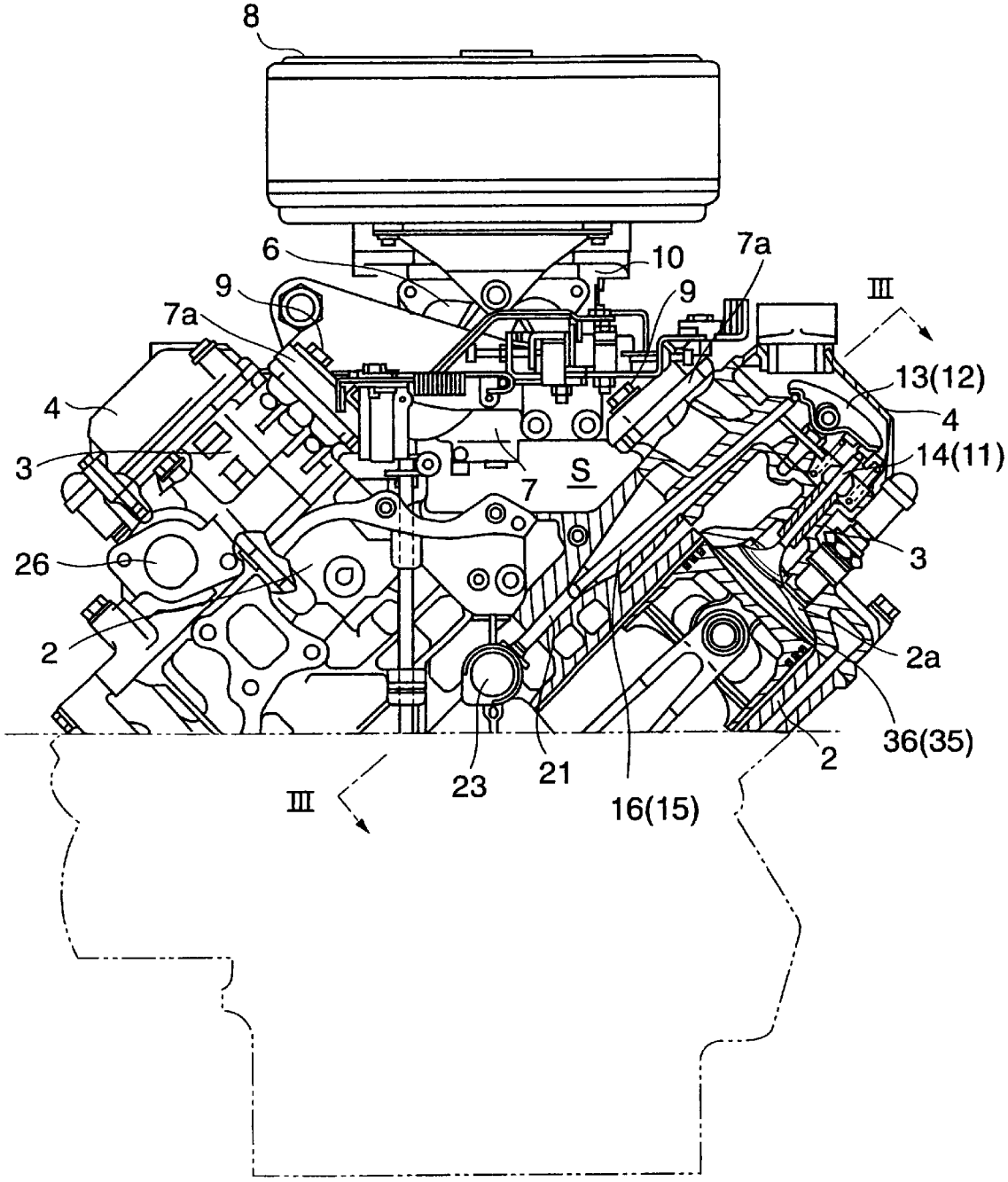
FIG. 2 is a partly sectional view taken on line II—II in FIG. 1 of an upper half of the water-cooled two-cylinder overhead-valve V-engine.

Referring to FIG. 2 showing a water-cooled two-cylinder overhead-valve V-engine in a first embodiment according to the present invention in a vertical sectional view, each of two cylinders arranged in V-shape has a cylinder block 2, a cylinder head 3 and a cylinder head cover 4. Each cylinder head 3 is provided with an intake valve 11 and an exhaust valve 14. A V-bank S is formed between the two cylinders. A camshaft 23 is extended in parallel to the axis of a crankshaft in a region near the bottom of the V-bank S in a crankcase. An intake valve rocker arm 12 and an exhaust valve rocker arm 13 respectively for operating the intake valve 11 and the exhaust valve 14 are connected by push rods 15 and 16, and tappets 21 to an intake valve driving cam and an exhaust valve driving cam formed on the camshaft 23, respectively. The camshaft 23 is rotated to drive the intake valves 11 and the exhaust valves 14 of the two cylinders.

A carburetor 6 and an intake manifold 7 having opposite ends provided with mounting flanges 7*a* are disposed in the V-bank S. The mounting flanges 7*a* of the intake manifold 7 are fastened to end surfaces of the cylinder heads 3 facing the V-bank S, respectively. An air cleaner 8 is disposed above the carburetor 6. An L-shaped intake pipe 10 connects the air cleaner 8 to the carburetor 6.

Figure 3:
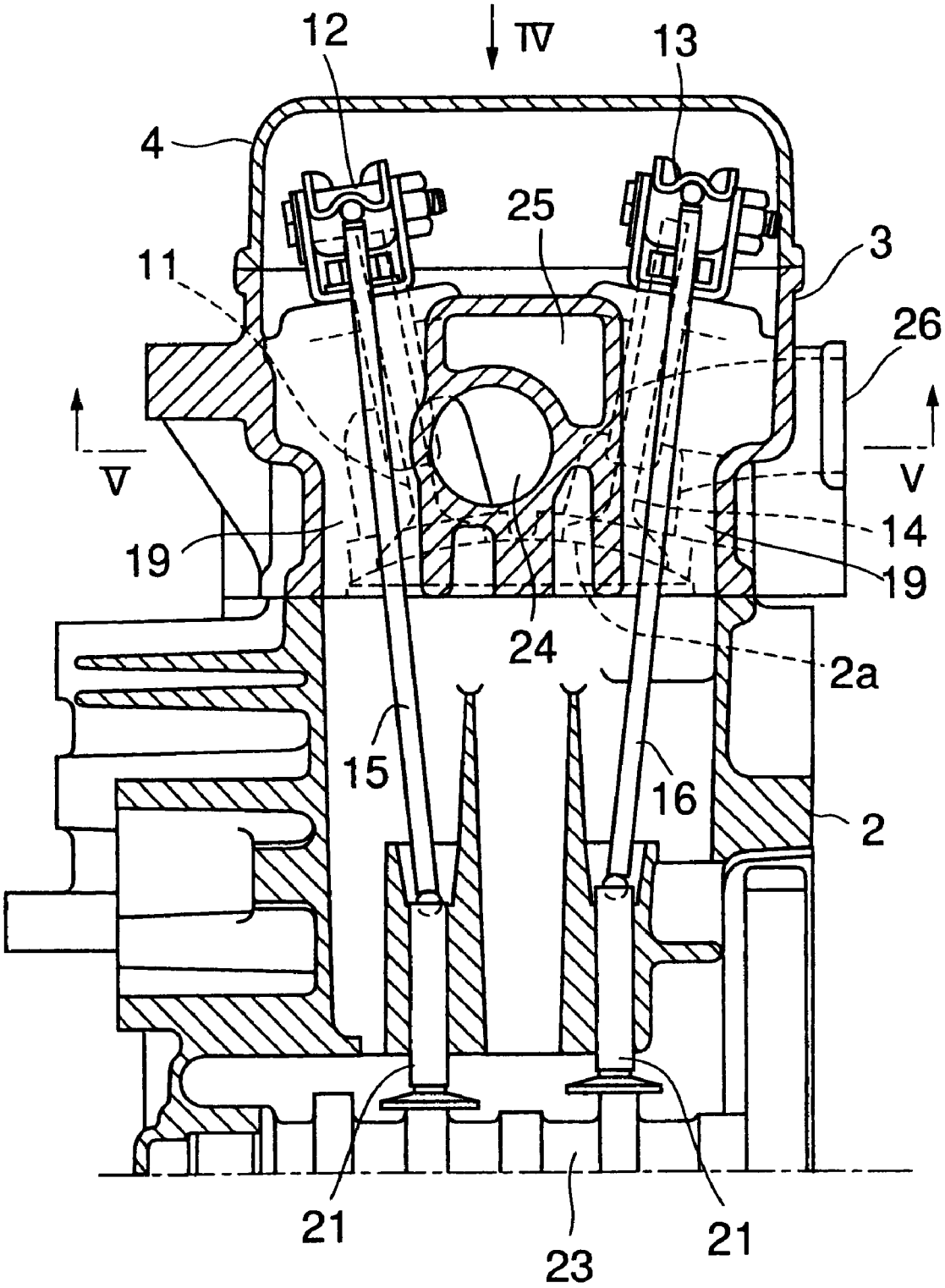
FIG. 3 is an enlarged sectional view taken on line III—III in FIG. 2.

Referring to FIG. 3 showing one of the two cylinders shown in FIG. 2 in an enlarged sectional view, the intake valve rocker arm 12 and the exhaust valve rocker arm 13 are supported for rocking motion on the upper surface of the cylinder head 3. The intake valve rocker arm 12 has one end in contact with the upper end of the intake valve 11 and the other end in contact with the upper end of the intake valve driving push rod 15. The exhaust valve rocker arm 13 has one end in contact with the upper end of the exhaust valve 14 and the other end in contact with the upper end of the exhaust valve driving push rod 16.

The push rods 15 and 16 extend respectively from the rocker arms 12 and 13 through push rod receiving holes 19 formed in the cylinder head 3 into the cylinder block 2. The lower ends of the push rods 15 and 16 rest on the upper ends of the tappets 21 engaging the cams of the camshaft 23, respectively. The push rods 15 and 16 extend gradually away from each other toward the rocker arms 12 and 13 so as to form a V-shape, so that parts of the push rods 15 and 16 in the cylinder head 3 are spaced a long distance apart from each other. An air intake port 24 and a cooling water outlet 25 are formed adjacently in a part of the cylinder head 3 between the push rods 15 and 16. The air intake port 24 has a circular cross section, and the cooling water outlet 25 has a substantially L-shaped cross section having a part extending along the circumference of the air intake port 24.

Figure 4:
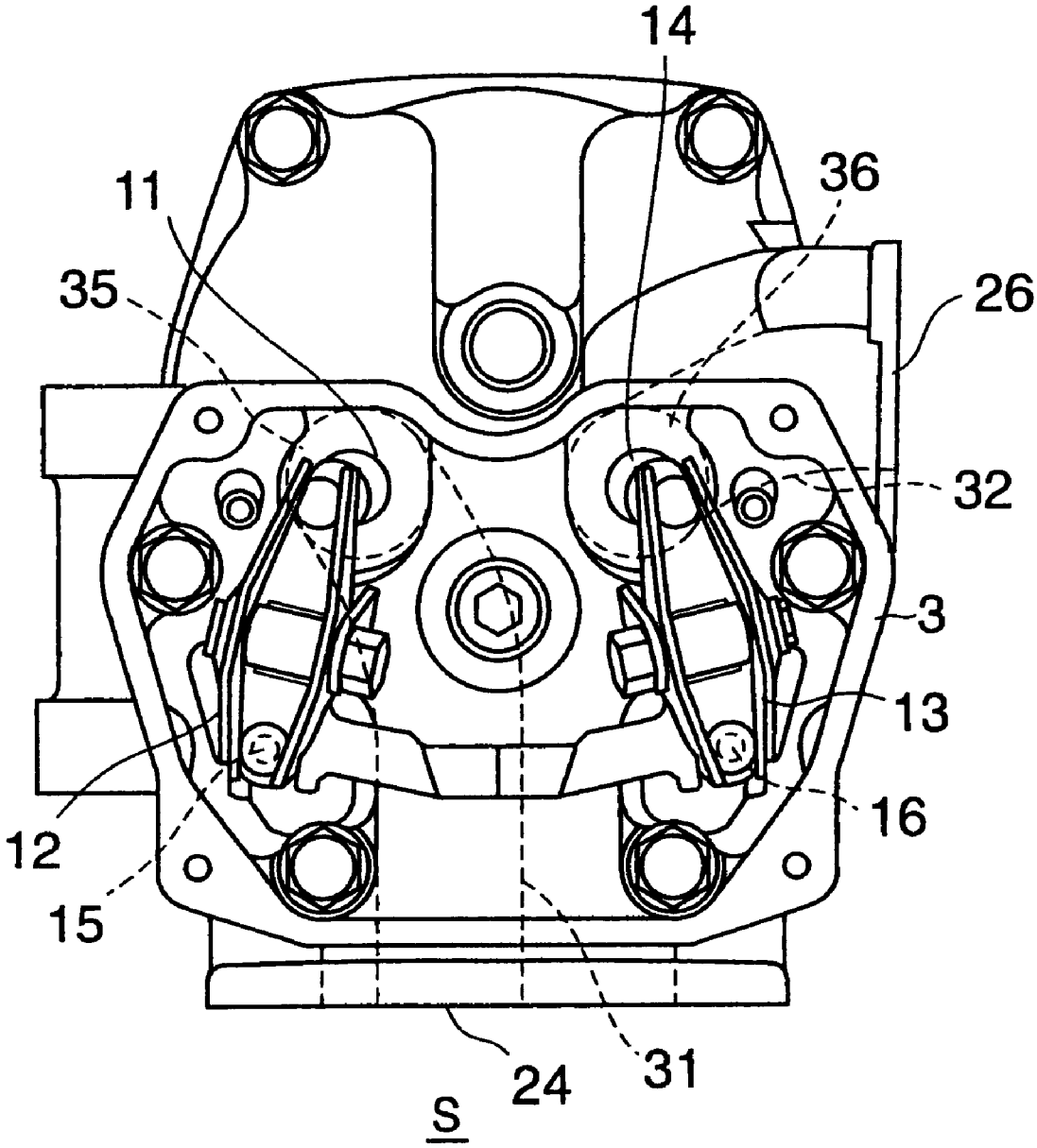
FIG. 4 is a view taken in the direction of the arrow IV in FIG. 3, in which a cylinder head cover is removed.

Referring to FIG. 4 (top view), the arrangement of an air intake passage 31, an exhaust passage 32, the intake valve 11, the exhaust valve 14, the intake valve rocker arm 12, the exhaust valve rocker arm 13 and the push rods 15 and 16 will be described. The air intake passage 31 extends in the cylinder head 3 from an inlet port 35 opening into a combustion chamber 2*a* (FIG. 2) through a central part of the cylinder head 3 and a part of the cylinder head 3 between the push rods 15 and 16 to the air intake port 24 opening into the V-bank S. The exhaust passage 32 extends from an exhaust valve port 36 opening into the combustion chamber 2*a* (FIG. 2) through the cylinder head 3 to an exhaust port 26 opening in the surface of the cylinder head output side substantially perpendicular to an inner side surface in which the air intake port 24 opens. The intake valve rocker arm 12 and the exhaust valve rocker arm 13 are disposed such that the distance between the ends thereof in contact with the push rods 15 and 16 is greater than that between the other ends thereof in contact respectively with the intake valve 11 and the exhaust valve 14.

Figure 5:
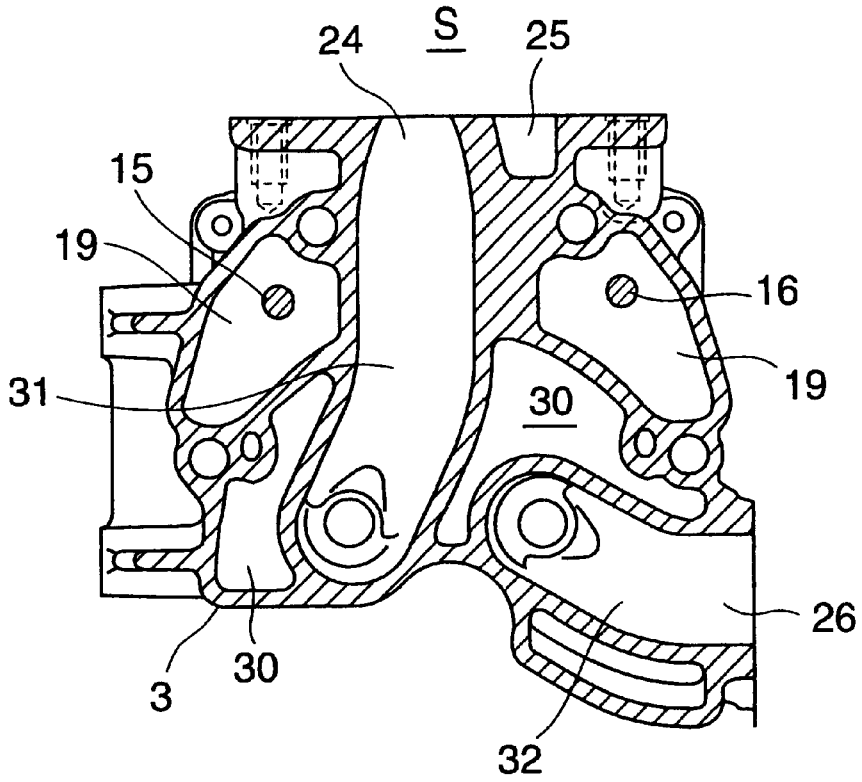
FIG. 5 is a sectional view taken on line V—V in FIG. 3.

Referring to FIG. 5, the cylinder head 3 is provided with a water jacket 30 to cool the cylinder head 3. The air intake port 24 and the cooling water outlet 25 of the water jacket 30 open into the V-bank S. The air intake port 24 is connected to the intake valve port 35 opened and closed by the intake valve 11 by the air intake passage 31 extending through the part of the cylinder head 3 between the push rod receiving holes 19. The exhaust port 26 formed in the other end surface in the direction of the crank axis is connected to the exhaust valve port 36 opened and closed by the exhaust valve 14 by the exhaust passage 32 (FIG. 4).

Figure 7:
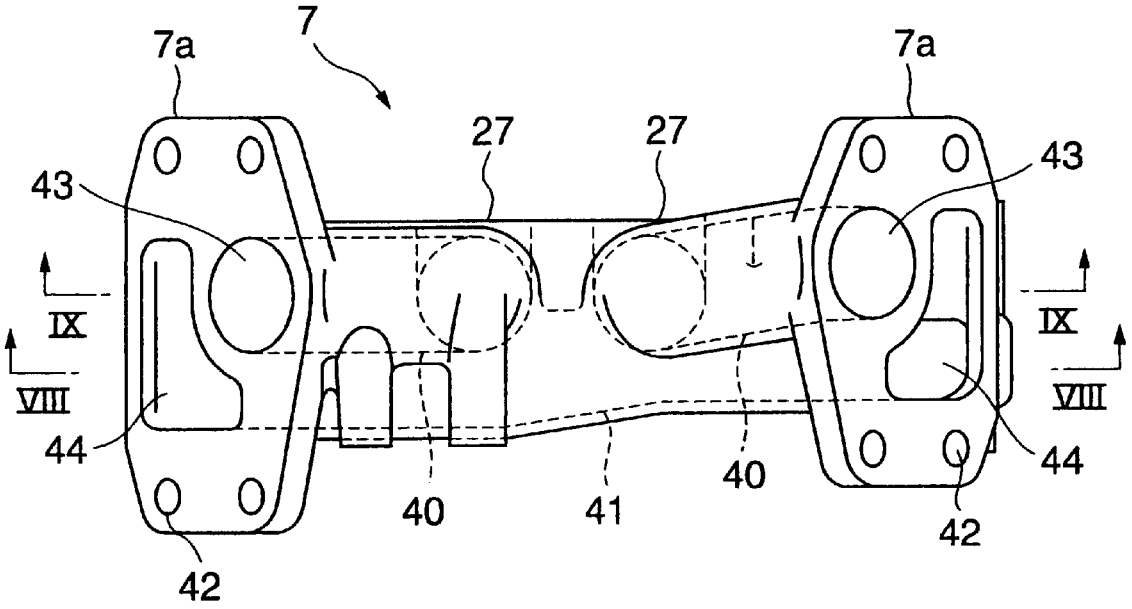
FIG. 7 is a bottom view of the intake manifold.

Referring to FIG. 7 showing the intake manifold 7 in a bottom view, the intake manifold 7 has a pair of air intake passages 40, and a cooling water passage 41 adjacent to the air intake passages 40. Each of the mounting flanges 7*a* of the intake manifold 7 is provided with four holes 42, an air passage opening 43 and a cooling water connecting opening 44. The respective shapes of the air passage opening 43 and the cooling water opening 44 correspond to those of the air intake port 24 and a cooling water outlet 25 of the cylinder head (FIG. 3), respectively.

Figure 6:
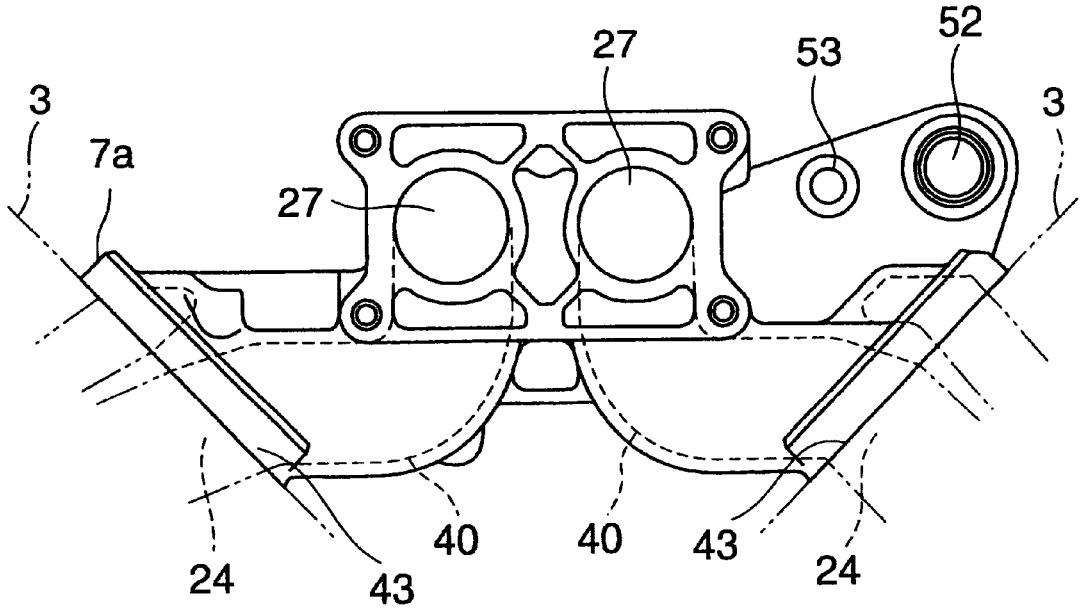
FIG. 6 is a front view of an intake manifold taken in the direction of the arrow VI in FIG. 1.

Referring to FIG. 6 showing the intake manifold 7 in a front view, the air passage openings 43 formed in the flanges 7*a* are connected to the air intake ports 24 of the cylinder heads 3, respectively. An inner end part of each air intake passage 40 is bent upward and terminates in an air intake port 27 opening toward a radiator 55.

Figure 8:
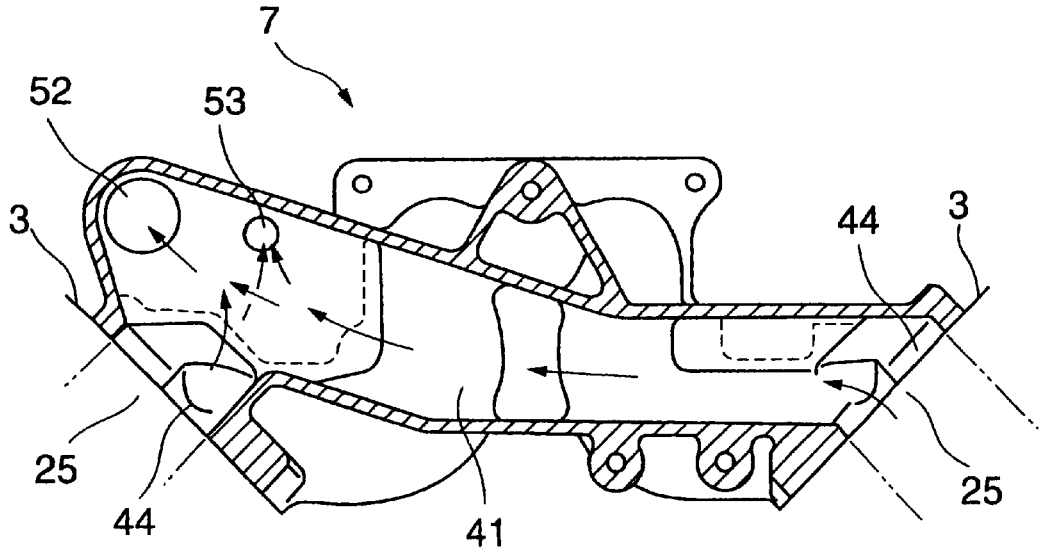
FIG. 8 is a sectional view taken on line VIII—VIII in FIG. 7.
Figure 9:
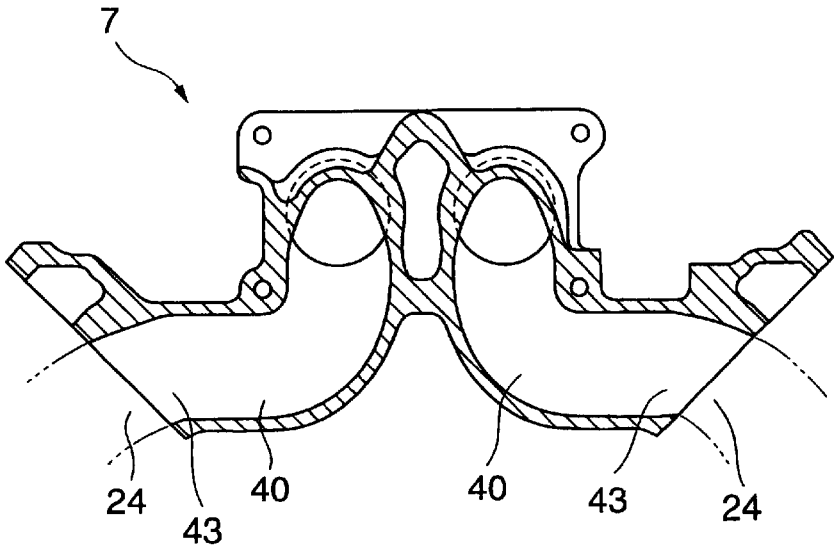
FIG. 9 is a sectional view taken on line IX—IX in FIG. 7.

Referring to FIG. 8 showing a cross section along the line VIII-VIII in FIG. 7, the cooling water connecting openings 44 formed at the opposite ends of the cooling water passage 41 are joined to the cooling water outlets 25 of the cylinder heads 3, respectively. A large cooling water outlet 52 and a small bypass cooling water outlet 53 are formed in parts of the intake manifold 7 above one of the cooling water connecting openings 44. The cooling water outlet 52 and the bypass cooling water outlet 53 open toward the radiator 55.

Figure 1:
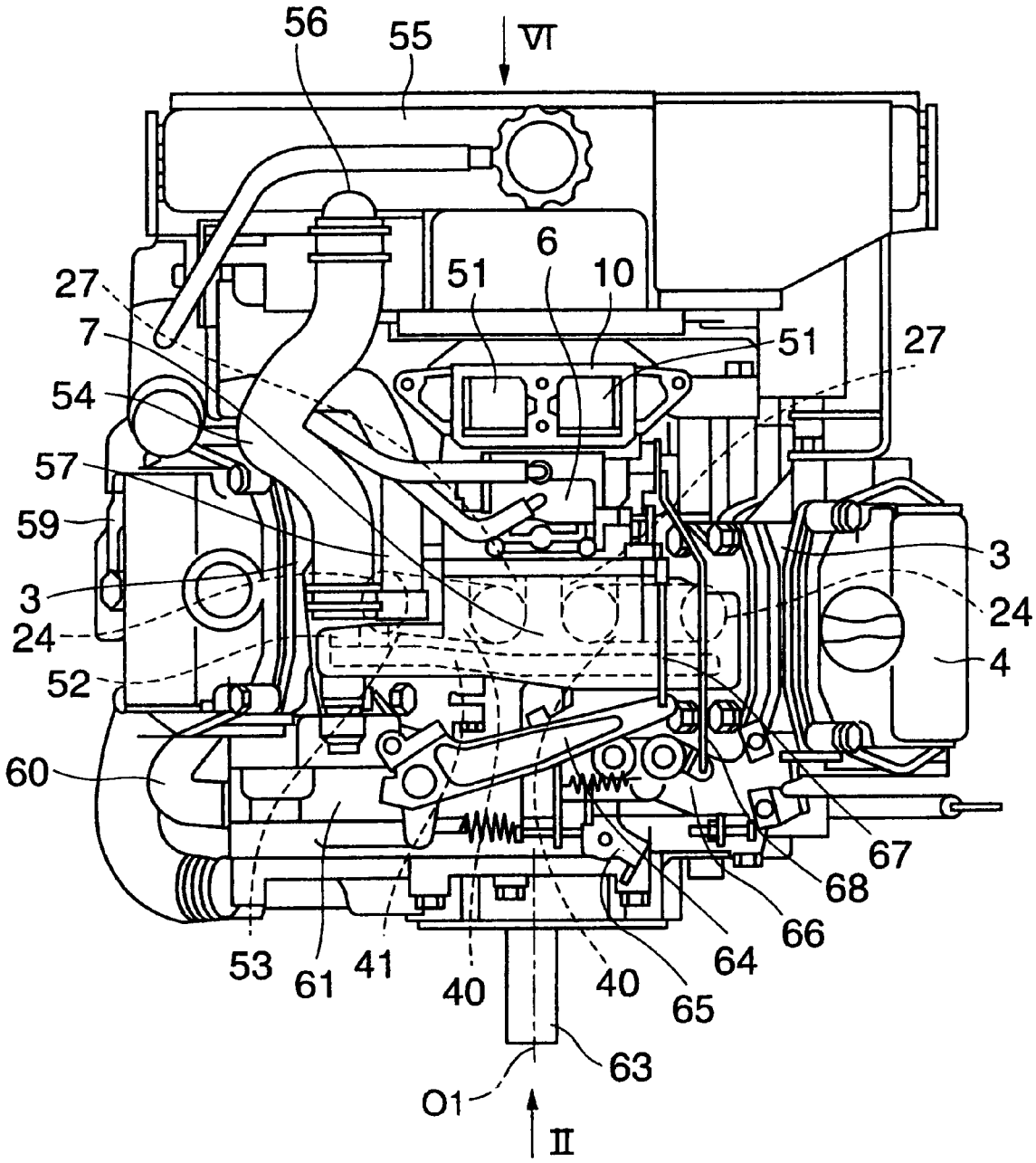
FIG. 1 is a plan view of a water-cooled two-cylinder overhead-valve V-engine in a first embodiment according to the present invention, in which an air cleaner is removed.

Referring to FIG. 1 showing the two-cylinder overhead valve V-engine of the present embodiment in a plan view, the carburetor 6 is a two-barrel carburetor provided with two individual air intake passages respectively for the two cylinders 3. The air intake passages of the carburetor 6 are connected to the air intake ports 27 of the intake manifold 7, respectively. The L-shaped intake pipe 10 has two individual inlets 51 respectively for the cylinders 3.

The radiator 55 is disposed on one side of the engine opposite the other side on which an output shaft 63 projects from the engine. The large cooling water outlet 52 of the intake manifold 7 is connected to a cooling water return port 56 of the radiator 55 by a radiator hose 54 of a big diameter. The small bypass cooling water outlet 53 is connected to a thermostat 59 disposed below the cylinder head 3 by a bypass hose 57 of a small diameter. The outlet port of the thermostat 59 is connected to a water pump 61 by a cooling water pipe 60. The outlet port of the water pump 61 is connected to the inlet ports of the water jackets of the cylinders.

A control panel 66 provided with a governor lever 64 and a throttle lever 65 is disposed on the side of the output shaft 63. The governor lever 64 and the throttle lever 65 are connected by a rod 67 and a link 68 to the levers of the carburetor 6.

The flow of the cooling water will be described. Referring to FIG. 8, the cooling water discharged through the cooling water outlets 25 of the cylinder heads 3 flows through the cooling water passage 41 formed in the intake manifold 7. Part of the cooling water is discharged through the cooling water outlet 52 connected to the radiator 55 and the rest is discharged through the bypass cooling water outlet 53. In FIG. 1, the cooling water discharged through the bypass cooling water outlet 53 flows through the bypass pipe 57 into the thermostat 59. The cooling water discharged through the cooling water outlet 52 flows through the radiator hose 54 and the cooling water return port 56 into the radiator 55.

The thermostat 59 is an inlet temperature sensing thermostat that measures the temperature of the cooling water at the inlet of the cooling water jacket. When the temperature of the cooling water measured by the thermostat 59 is lower than a set temperature, the thermostat 59 closes the cooling water passage connected to the radiator 55 and permits the cooling water to flow only through the bypass pipe 57 into the water pump 61. When the temperature of the cooling water is not lower than the set temperature, the thermostat 59 opens the cooling water passage connected to the radiator 55 to supply both the cooling water cooled by the radiator 55 and the cooling water flowing through the bypass pipe 57 into the water pump 61.

The flow of intake air will be described. Air cleaned by the air cleaner 8 shown in FIG. 2 flows through the inlets 51 of the intake pipe 10, and the air passages of the carburetor 6. The air is mixed with the fuel in the carburetor 6 to produce an air-fuel mixture. Then the mixture flows through the air passages 40 of the intake manifold 7, and the air intake ports 24 of the cylinder heads 3 into the cylinders.

Since the air-fuel mixture flows from the carburetor 6 into the intake manifold 7, and flows through the substantially shortest air intake passages 40 and the air intake ports 24 formed in the inner side surfaces facing the V-bank S of the cylinder heads 3 into the cylinders, intake passage resistance is small and the stagnation of the fuel and the oil in the air intake passages 40 can be avoided.

Since the cooling water outlet 52 of the intake manifold 7 opens toward the radiator 55, the radiator hose 54 connecting the cooling water outlet 52 and the return port 56 of the radiator 55 may be short.

Figure 10:
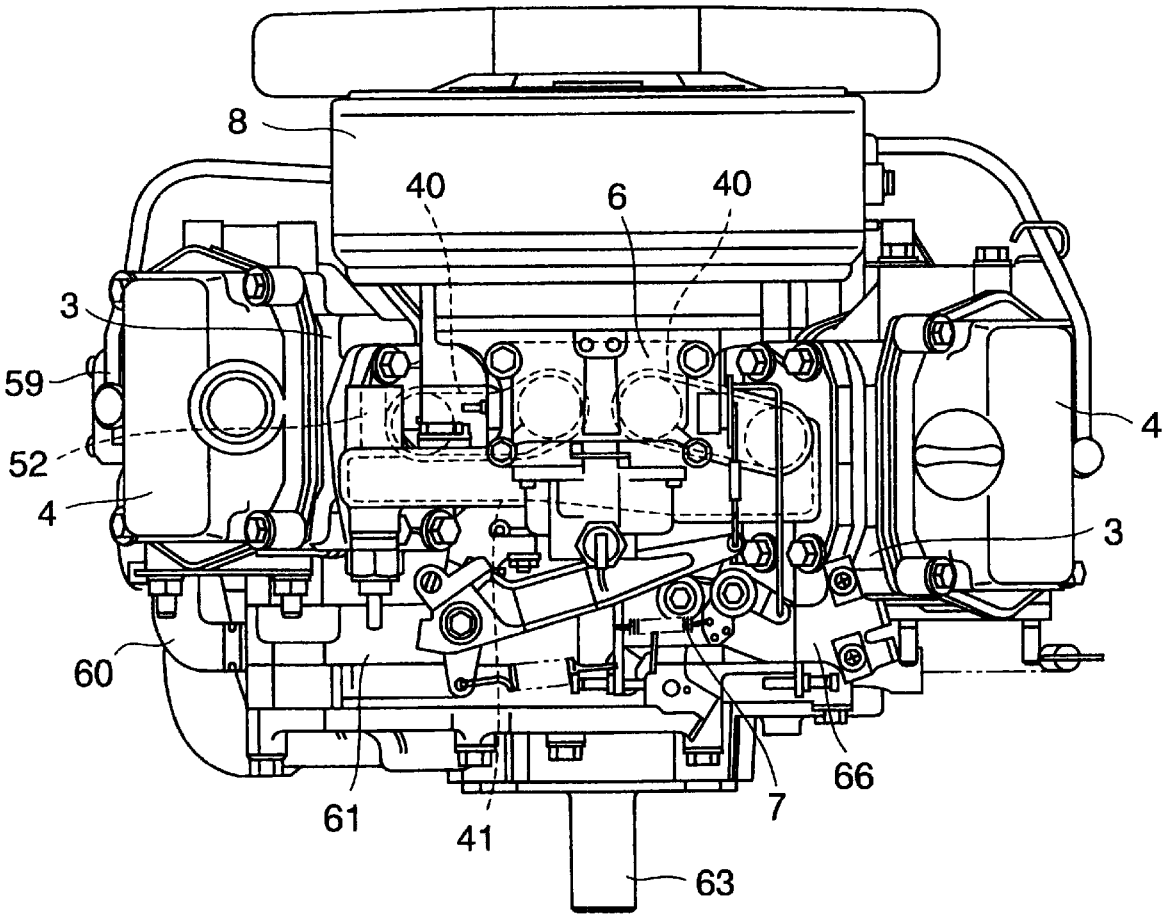
FIG. 10 is a plan view of a water-cooled two-cylinder overhead-valve V-engine in second embodiment according to the present invention.
Figure 11:
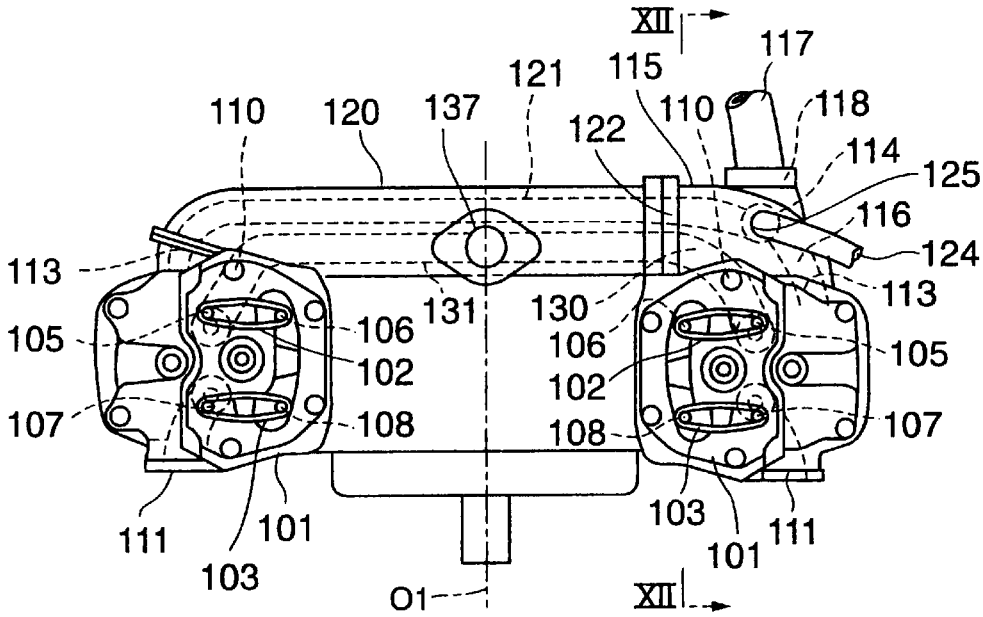
FIG. 11 is a plan view of a conventional water-cooled two-cylinder overhead-valve V-engine.
Figure 12:
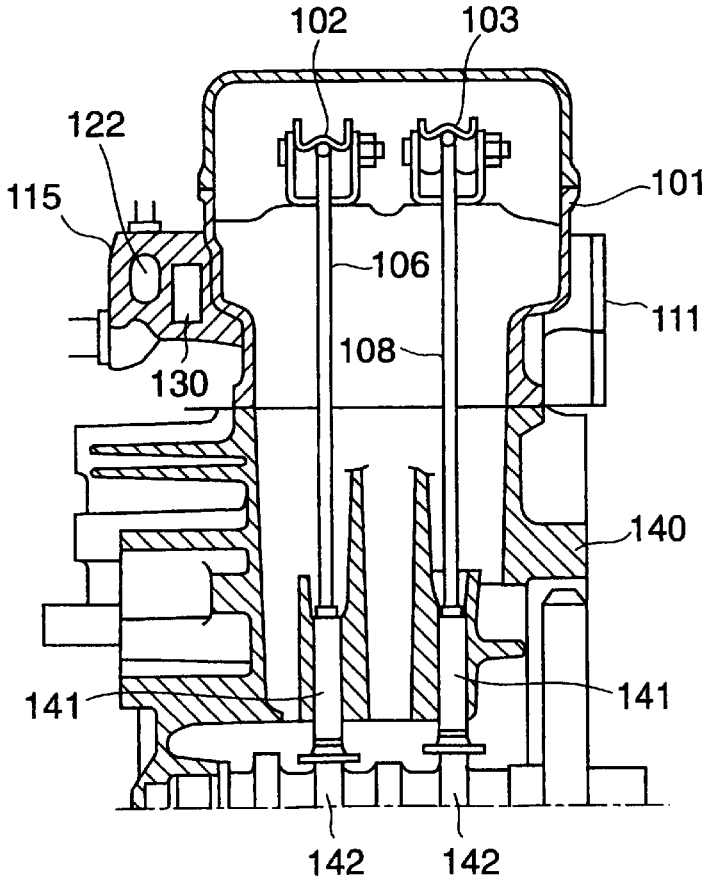
FIG. 12 is a sectional view taken on line XII—XII in FIG. 11.

A water-cooled two-cylinder overhead-valve V-engine in a second embodiment according to the present invention will be described with reference to FIG. 10, in which parts like or corresponding to those of the foregoing water-cooled two-cylinder overhead-valve V-engine in the first embodiment will be denoted by the same reference characters. In FIG. 10, a radiator, and hoses and pipes connected with the radiator are omitted and only a cooling fan is shown. Two cylinders respectively provided with cylinder heads 3 are arranged so as to form a V-bank between the two cylinders. An intake manifold 7 is disposed in the V-bank, a downdraft carburetor 6 is disposed above the intake manifold 7, and an air cleaner 8 is disposed in one side of the carburetor 6 in the direction of the crank axis. The intake manifold 7 is provided with a pair of air intake passages 40 and a cooling water passage 41 adjacent to the air intake passages 40. As shown in FIG. 3, the outlets of the air intake passages 40 and the inlets of the cooling water passage 41 are connected to the air intake ports 24 and the cooling water outlets 25, which are formed in parts of the cylinder heads 3, between push rods 15 and 16 extended 16 in a V-shape. The inlets of the air intake passages 40 open upward and are connected to the outlets of the air intake passages of the carburetor 6. The air cleaner 8 may be disposed above the carburetor 6. The water-cooled two-cylinder overhead valve V-engine in the second embodiment is the same in other respects as the water-cooled two-cylinder overhead-valve V-engine in the first embodiment.

The air cleaner 8 of the second embodiment has a large cleaning capacity and can be formed in a small dimension in the direction of the crank axis because the same is disposed near the V-bank between the two cylinders, so that the water-cooled two-cylinder overhead-valve V-engine can be formed in a small dimension in the direction of the crank axis.

The present invention is applicable to either a two-cylinder overhead valve V-engine with a horizontal output shaft or a two-cylinder overhead valve V-engine with a vertical output shaft. Only the air intake passages may be formed in the intake manifold and the cooling water passage may be formed in a cooling water pipe instead of forming both the air intake passages and the cooling water passage in the intake manifold.

Although the invention has been described in its preferred embodiments with a certain degree of particularity, obviously many changes and variations may be made therein. It is therefore to be understood that the present invention may be practiced otherwise than as specifically described herein without departing from the scope and spirit thereof.

What is claimed is:

1. A two-cylinder overhead-valve V-engine comprising:

a pair of cylinders arranged so as to form a V-shape in which a V-bank is formed, each of said cylinders including a cylinder head with an intake valve and an exhaust valve;

a camshaft disposed below said V-bank in parallel to an axis of a crankshaft;

intake valve rocker arms for operating said intake valves, respectively;

exhaust valve rocker arms for operating said exhaust valves, respectively; and push rods for operating said intake valve rocker arms and said exhaust valve rocker arms, respectively, said push rods being connected to said camshaft by tappets, respectively, each pair of said push rods for each of said cylinders being extending gradually away from each other toward each of valve rocker arm chambers in which said valve rocker arms are housed, wherein, between each pair of said push rods for each of said cylinders, each of air intake passages with air intake ports for said cylinder heads is formed, each of said air intake ports being formed so as to open into said V-bank, each of said air intake ports being connected by each of said air intake passages formed in said V-bank to a carburetor disposed in said V-bank.

2. The two-cylinder overhead-valve V-engine according to claim 1, wherein, together with said air intake ports, cooling water outlets of water jackets for said cylinders are formed so as to each open between each pair of said push rods for each of said cylinders, said cooling water outlets of said water jackets being connected by a cooling water passage adjacent to said air intake passages disposed in said V-bank.

3. The two-cylinder overhead-valve V-engine according to claim 2, wherein said cooling water passage connecting said cooling water outlets of said water jackets is provided with a cooling water outlet connected to a radiator.

* * * * *